US008552658B2

(12) United States Patent
Zhang et al.

(10) Patent No.: US 8,552,658 B2
(45) Date of Patent: Oct. 8, 2013

(54) LIGHT-EMITTING DIODE (LED) DRIVER AND CONTROLLER

(75) Inventors: Wanfeng Zhang, Palo Alto, CA (US); Jianqing Lin, Pleasanton, CA (US); Shaoan Dai, Cupertino, CA (US)

(73) Assignee: Marvell World Trade Ltd., St. Michael (BB)

( * ) Notice: Subject to any disclaimer, the term of this patent is extended or adjusted under 35 U.S.C. 154(b) by 578 days.

(21) Appl. No.: 12/547,240

(22) Filed: Aug. 25, 2009

(65) Prior Publication Data

US 2010/0079081 A1 Apr. 1, 2010

Related U.S. Application Data

(60) Provisional application No. 61/092,578, filed on Aug. 28, 2008.

(51) Int. Cl.
*H05B 37/02* (2006.01)

(52) U.S. Cl.
USPC ..... 315/291; 315/225; 315/279

(58) Field of Classification Search
USPC ..... 315/225, 276, 279, 291, 294, 297
See application file for complete search history.

(56) References Cited

U.S. PATENT DOCUMENTS

| | | | | |
|---|---|---|---|---|
| 6,867,986 | B2 * | 3/2005 | Amei | 363/21.01 |
| 7,781,982 | B2 * | 8/2010 | Tatsumi | 315/291 |
| 7,800,037 | B2 * | 9/2010 | Sawtell et al. | 250/206 |
| 7,808,802 | B2 * | 10/2010 | Cai | 363/21.12 |
| 8,330,391 | B2 * | 12/2012 | Wendt et al. | 315/307 |
| 2008/0203932 | A1 * | 8/2008 | Ball | 315/189 |
| 2008/0303452 | A1 * | 12/2008 | Van Erp | 315/294 |

* cited by examiner

*Primary Examiner* — James H Cho

(57) ABSTRACT

Apparatuses, methods, systems, and circuits for light-emitting diode (LED) control are disclosed. In one embodiment, an LED control circuit can include a first pin receiving an input voltage supply; a second pin receiving a primary signal from a primary winding of a transformer coupled to the LED; a third pin coupled to a ground supply; and logic configured to estimate an output current and/or output voltage at the LED coupled to a secondary winding of the transformer from the input voltage supply and the primary signal.

18 Claims, 6 Drawing Sheets

LIGHT-EMITTING DIODE (LED) DRIVER AND CONTROLLER

RELATED APPLICATIONS

This application claims the benefit of U.S. Provisional Application No. 61/092,578, filed Aug. 28, 2008, the contents of which are incorporated herein by reference in its entirety.

FIELD OF THE INVENTION

The present invention generally relates to the field of electronic control systems. More specifically, embodiments of the present invention pertain to circuits and methods for controlling a light-emitting diode (LED).

DISCUSSION OF THE BACKGROUND

Light-emitting diodes (LEDs) are typically powered using transformer and rectifier circuitry. The rectifier(s), which can be part of an alternating current (AC) to direct current (DC) converter, may convert AC voltage levels (e.g., ±110V) to DC voltage levels (e.g., VDD and ground), and/or clip AC voltage levels to minimize the voltage amplitude (e.g., from the AC input voltage). The transformer may be used to change the rectified input voltage to a converted voltage (e.g., by a ratio based on the primary and secondary windings of the transformer) that is more suitable for the LED device. Typical control circuits for LEDs include analog-based "flyback" control that uses secondary winding feedback information to control certain functions of the LED device.

Drawbacks of secondary winding-based LED control can include higher costs and increased chip size due to use of an optical coupler (to translate an optical-based feedback signal from the LED to an electrical signal), reduced reliability associated with the optical coupler (due to the relatively high failure rate of optical couplers over time), and limited functionality when the flyback control circuitry includes purely analog circuits.

SUMMARY OF THE INVENTION

Embodiments of the present invention relate to circuits and methods for controlling a light-emitting diode (LED).

In one aspect, an LED control circuit can include a first input (e.g., a first pin) receiving an input voltage supply, a second input (e.g., a second pin) receiving a primary signal from a primary winding of a transformer coupled to the LED, an optional third input (e.g., a third pin) coupled to a ground supply, and logic configured to estimate an output current and/or an output voltage in (or at) the LED from the input voltage supply and the primary signal. In various embodiments, the output current is estimated by the primary side winding current when primary side switch is on, and the output voltage is estimated by the primary side winding voltage when primary side switch is off.

The primary signal can include a primary voltage and a primary current of the transformer. The logic in the LED control circuit can include an output voltage estimator to provide the output voltage estimation from the input voltage supply and the primary voltage, and an output current estimator to receive the primary current and provide the output current estimation when a switch on the primary side of the transformer is on. In addition, each of the output voltage estimator and the output current estimator can consist of or consist essentially of digital and/or mixed signal circuits.

The logic in the LED control circuit can also include a mixer that receives the input voltage supply and the primary voltage, and provides a control voltage therefrom. This logic can also include a voltage control circuit that receives the control voltage, a threshold voltage and a clock signal, and generates a voltage control indicator therefrom. The voltage control circuit can include a comparator configured to compare the control voltage and the threshold voltage, and a counter that receives the clock signal and an output from the comparator, and provides the voltage control indicator. Also, the voltage control indicator may have a value corresponding to a length of time that the control voltage exceeds the threshold voltage.

In another aspect, a method of controlling an LED can include determining if a secondary winding of a transformer has a non-zero current passing through it by comparing a threshold voltage and a primary voltage at a primary winding of the transformer; estimating an output current through the LED (or a secondary winding of the transformer) using a current passing through the primary winding when a switch on the primary side of the transformer is on; counting a number of clock cycles during which the secondary winding has a non-zero current and/or a diode on the secondary side is on, and estimating an output voltage in the LED (or at a terminal of the secondary winding) using the primary voltage when the primary side switch is off. For example, the output voltage can be estimated at an output of the secondary winding, an output of a diode, rectifier or filter coupled to the secondary winding, or an input to the LED itself.

The method can also include generating a pulse from the estimated output current and the estimated output voltage, and producing a current at a terminal of the primary winding by applying the pulse to a gate of a transistor coupled to the primary winding. The transistor can have a source coupled to the ground supply, and a drain coupled to the primary winding. In various embodiments, estimating the output voltage can further comprise mixing the input voltage supply and a voltage at a terminal of the primary winding, and providing a control voltage therefrom; comparing the control voltage against a threshold voltage, and generating a diode on indicator therefrom; counting a number of cycles of the clock signal while the diode on indicator is active; and estimating the output voltage using the number of cycles and the control voltage. In one implementation, the output voltage is estimated according to $$V_{OX} = \sum_{D_{ON}} V_{PX} / (N * D_{ONCNT}),$$

where $D_{ONCNT}$ indicates the number of clock cycles for which the diode on indicator is active, N indicates a transformer winding ratio, and $V_{PX}$ indicates the control voltage.

In other embodiments, estimating the output current can further comprise sampling the current at a terminal of the primary winding; counting a number of cycles of the clock signal while the pulse is active; and averaging the sampled current during the number of cycles while the pulse is active. In one implementation, the output current can be estimated according to $$I_{OX} = N * D_{ONCNT} * \sum_{T_{ON}} I_P / (T_{ONCNT} * PWM_{CNTQ}),$$

where $I_P$ indicates the primary current, $T_{ONCNT}$ indicates a duration of an on time of the transistor, and $PWM_{CNTQ}$ indicates a pulse width modulation control signal value or parameter, which represents the switching period.

In another aspect, an apparatus can include a transformer having a primary winding and a secondary winding, where the secondary winding is coupled to the LED; and a controller having a first input (e.g., a first pin) coupled to an input voltage supply, a second input (e.g., a second pin) coupled to a terminal of the primary winding, and an optional third input (e.g., a third pin) coupled to a ground supply. The controller is generally configured to control the LED using the input voltage supply, a voltage at the primary winding terminal, and a current at the second pin, to estimate operating conditions at the LED. In various embodiments, the pins of the controller consist of the first pin, the second pin, the third pin, and optionally a fourth pin configured to receive a dimming control signal.

The controller in the apparatus can include an NMOS transistor having a source coupled to the ground supply, a drain coupled to the second terminal of the primary winding, and a gate receiving an LED/duty cycle control signal. The apparatus can also include a duty cycle controller that receives the input voltage supply and the primary current, and controls a gate of the NMOS transistor therefrom.

The duty cycle controller can include a mixer configured to receive the input voltage supply and a voltage at the second terminal of the primary winding, and to provide a control voltage therefrom; a comparator configured to compare the control voltage against a threshold voltage, and to generate therefrom a diode on indicator (e.g., a signal indicating that a diode coupled to the secondary winding is on); a counter configured to receive the diode on indicator and a clock signal, and count of a number of cycles of the clock signal when the diode is on; an output voltage estimator configured to receive the count of the number of cycles and the control voltage, and to provide an output voltage estimation therefrom, the output voltage being coupled or provided to the LED; and/or an output current estimator configured to receive the primary current and to provide an output current estimation therefrom when a primary side switch receiving the LED control signal and/or coupled to the primary winding (e.g., the NMOS transistor) is on. Alternatively, the duty cycle controller can include a secondary current estimator instead of the output current estimator, wherein the secondary current estimator estimates the current passing through the secondary winding of the transformer.

In the apparatus, the output voltage can be estimated according to $$V_{OX} = \sum_{D_{ON}} V_{PX} / (N * D_{ONCNT}),$$

and the output current can be estimated according to $$I_{OX} = N * D_{ONCNT} * \sum_{T_{ON}} I_P / (T_{ONCNT} * PWM_{CNTQ}),$$

where the terms of the equations are as described herein. The apparatus can also include a gate controller to receive the output (or secondary) current estimation, the output voltage estimation, a reference voltage, and a reference current, and provide a control signal for the gate of the NMOS transistor therefrom. The gate controller can further include a pulse width modulator, an error amplifier, and/or a loop filter.

Embodiments of the present invention may advantageously provide a circuit and method for controlling an LED using primary voltage and current information from the transformer primary winding. The present feedback control approach can avoid use of an optical coupler. The present circuit may include (or consist essentially of) digital and/or mixed signal circuitry, thereby reducing chip size and increasing system flexibility. These and other advantages of the present invention will become readily apparent from the detailed description of preferred embodiments below.

DETAILED DESCRIPTION

Figure 1A:
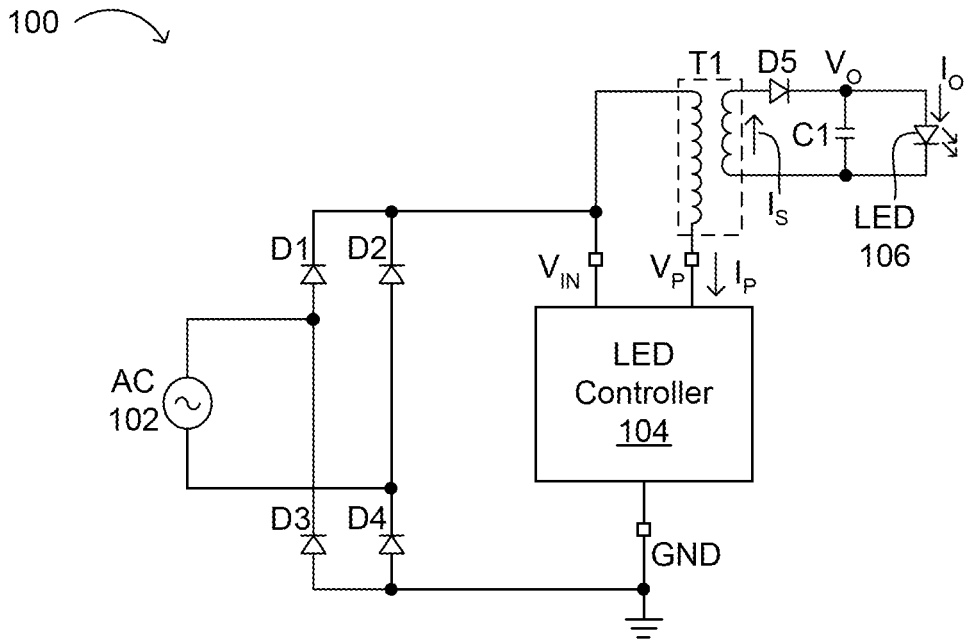
FIG. 1A is a block schematic diagram showing a first exemplary light-emitting diode (LED) controller system in accordance with embodiments of the present invention.

Reference will now be made in detail to embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, the present invention may be practiced without these specific details. In other instances, well-known methods, procedures, components, and circuits have not been described in detail so as not to unnecessarily obscure aspects of the present invention.

Some portions of the detailed descriptions which follow are presented in terms of processes, procedures, logic blocks, functional blocks, processing, and other symbolic representations of operations on data bits, data streams or waveforms within a computer, processor, controller and/or memory. These descriptions and representations are generally used by those skilled in the data processing arts to effectively convey the substance of their work to others skilled in the art. A process, procedure, logic block, function, operation, etc., is herein, and is generally, considered to be a self-consistent sequence of steps or instructions leading to a desired and/or expected result. The steps generally include physical manipulations of physical quantities. Usually, though not necessarily, these quantities take the form of electrical, magnetic, optical, or quantum signals capable of being stored, transferred, combined, compared, and otherwise manipulated in a computer, data processing system, or logic circuit. It has proven convenient at times, principally for reasons of common usage, to refer to these signals as bits, waves, waveforms, streams, values, elements, symbols, characters, terms, numbers, or the like.

All of these and similar terms are associated with the appropriate physical quantities and are merely convenient labels applied to these quantities. Unless specifically stated otherwise and/or as is apparent from the following discussions, it is appreciated that throughout the present application, discussions utilizing terms such as "processing," "operating," "computing," "calculating," "determining," "manipulating," "transforming," or the like, refer to the action and processes of a computer, data processing system, logic circuit or similar processing device (e.g., an electrical, optical, or quantum computing or processing device), that manipulates and transforms data represented as physical (e.g., electronic) quantities. The terms refer to actions, operations and/or processes of the processing devices that manipulate or transform physical quantities within the component(s) of a system or architecture (e.g., registers, memories, other such information storage, transmission or display devices, etc.) into other data similarly represented as physical quantities within other components of the same or a different system or architecture.

Furthermore, for the sake of convenience and simplicity, the terms "signal(s)" and "waveform(s)" may be used interchangeably. However, these terms are generally given their art recognized meanings. Also, for convenience and simplicity, the terms "clock," "time," "rate," "period" and "frequency" may be used interchangeably, as well as the terms "data," "data stream," "waveform" and "information," and in general, use of one such form generally includes the others, unless the context of the use unambiguously indicates otherwise. The terms "node(s)," "input(s)," "output(s)," and "port(s)" may be used interchangeably, as well as the terms "connected to," "coupled with," "coupled to," and "in communication with" (which terms also refer to direct and/or indirect relationships between the connected, coupled and/or communicating elements, unless the context of the term's use unambiguously indicates otherwise). However, these terms are also generally given their art-recognized meanings.

The invention, in its various aspects, will be explained in greater detail below with regard to exemplary embodiments.

An Exemplary LED Controller System

FIG. 1A shows a block schematic diagram 100 of an exemplary light-emitting diode (LED) controller system in accordance with embodiments of the present invention. This particular example can include a controller (e.g., LED controller 104) having a 3-pin (e.g., $V_{IN}$, $V_P$, and GND) signal interface. The controller system 100 can receive an AC type signal 102 as an input supply $V_{IN}$. The AC signal 102 may have a waveform that is substantially sinusoidal, square, triangular, etc., as is known in the art. For example, input supply $V_{IN}$ can have a frequency of from about 50 Hz to about 60 Hz, and an amplitude of from about 90 V to about 277V. However, any suitable frequencies, amplitudes, waveform shapes, etc., can be accommodated in particular embodiments. For example, the AC signal 102 may be a conventional powerline AC power supply, or the AC signal 102 may be a wireless signal (e.g., a high frequency [HF], radio frequency [RF], very high frequency [VHF], or ultra high frequency [UHF] signal, etc.). The AC signal 102 is rectified by diodes D1, D2, D3, and D4 to provide input supply $V_{IN}$ to LED controller 104, although other rectifier circuits (e.g., bridge rectifiers) may also be suitable. LED controller 104 also receives primary winding current $I_P$ from a primary winding of transformer T1.

In particular embodiments, primary winding current $I_P$ and input voltage information $V_{IN}$ may be used to control a transistor (e.g., the gate G of MOS transistor M1 in FIG. 2) that, in turn, controls illumination of LED 106 (see FIG. 1). LED 106 may be coupled to transformer T1 through a filter comprising diode D5 and capacitor C1. Transformer T1 can thus generate a secondary winding current $I_S$ in the secondary winding of transformer T1 to power LED 106. For example, transformer T1 can be an N:1 transformer, whereby the number of primary windings is an integer multiple of the number of secondary windings (i.e., where N can be any integer of 2 or more, such as 2, 3, 4, etc.).

Particular embodiments use a "flyback" topology to estimate the current ($I_O$) and voltage ($V_O$) at the LED (or the current $I_S$ through the secondary winding of the transformer T1) by sensing the primary winding current $I_P$ and voltage $V_P$. In such a flyback topology, energy from an input (e.g., AC 102, $V_{IN}$) is transferred into or stored in a magnetic component (e.g., transformer T1). This energy can later be released (e.g., using LED controller 104) from the magnetic component and into the load (e.g., LED 106) when there is a current ($I_S$) through the secondary side winding. The current at the second pin may result from turning on a switch (e.g., transistor M1 in FIG. 2) that is coupled to the second pin. Certain embodiments are also suitable for other LED controller topologies and/or arrangements, and particularly those where current and/or voltage information can be isolated from or transformed, relative to those LED controllers that more directly control the LED. For example, in some embodiments, the direction of the current $I_S$ through the secondary winding of transformer T1 is the opposite of that shown. Also, in various embodiments, the output voltage $V_O$ is estimated at an output of the secondary winding, an output of a diode (e.g., D5), a rectifier (e.g., comprising one or more diodes D5, such as a half-bridge rectifier) or filter coupled to the secondary winding, or an input to the LED itself. Similarly, the output current can be estimated at the same nodes as the output voltage, or it can be estimated at or through the LED 106 or through the secondary winding of the transformer T1.

Because LED controller 104 receives information from the primary winding of transformer T1, direct or indirect sensing of the secondary current $I_S$ (e.g., from the optical output of LED 106) can be avoided. Also, a digital signal processor (DSP), system on a chip (SoC), or other digital or mixed-signal control circuitry can be employed in particular embodiments of LED controller 104. In particular, and now referring to FIG. 2, the primary current ($I_P$) can be sensed when the control transistor M1 is turned on, and the primary voltage $V_P$ (e.g., the drain [D] to source [S] voltage across the control transistor M1; see FIG. 2) can be sensed when the control transistor M1 is turned off, in order to estimate the output current $I_O$ (or the secondary output current $I_S$) and the output voltage ($V_O$) at LED 106.

Figure 1B:
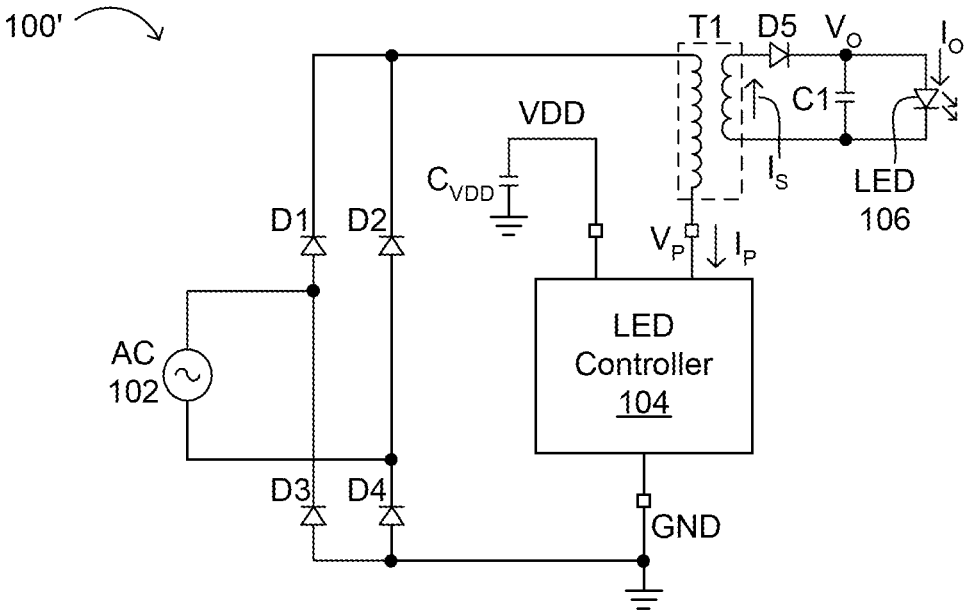
FIG. 1B is a block schematic diagram showing a second exemplary LED controller system in accordance with embodiments of the present invention.

FIG. 1B shows a block schematic diagram 100' of a second exemplary LED controller system in accordance with embodiments of the present invention. In this particular variation, the first pin of the LED controller 104 is directly coupled to a VDD power supply (e.g., across capacitance $C_{VDD}$). In this fashion, VDD may be used as a relatively fixed power supply for LED controller 104 (e.g., an integrated circuit [IC]), while the second pin receives an input from the primary winding or coil of transformer T1 (e.g., for sensing the primary voltage $V_P$), with the third pin of LED controller 104 receiving a ground potential GND.

In this fashion, embodiments of the invention can estimate secondary current and voltage (i.e., of the secondary winding or coil of transformer T1) using information from the primary winding or coil of transformer T1. Particular embodiments also utilize digital control circuitry for the LED driver (e.g., control transistor), and a digital or mixed signal interface for other suitable LED functions. This approach may result in lower costs, smaller controller die size, and increased controller reliability, as compared to conventional approaches, such as those that use an optical coupler to provide information regarding the secondary winding or the transformer.

In addition, particular embodiments can support additional functionality due to digital/DSP based control, such as networking/communication functions that may be included in the DSP block. For example, LED controller 104 can be implemented in a DSP, SoC, or other digital control block, to support networking/communication functions, such as remote control of LED 106 by way of network commands. In one example, a user at a remote location can control a dimming function of LED 106 through a network (e.g., the Internet, WiFi, mobile device protocols, cellular networks, virtual private networks [VPNs], etc.) that is coupled to LED controller 104. Other functions include on/off timing of the primary (or primary side) switch, M1, independent control of multiple LEDs 106, security-based control of LED 106, and so on. Such functionality may also be controlled by one or more manual switches and/or network commands.

Figure 2:
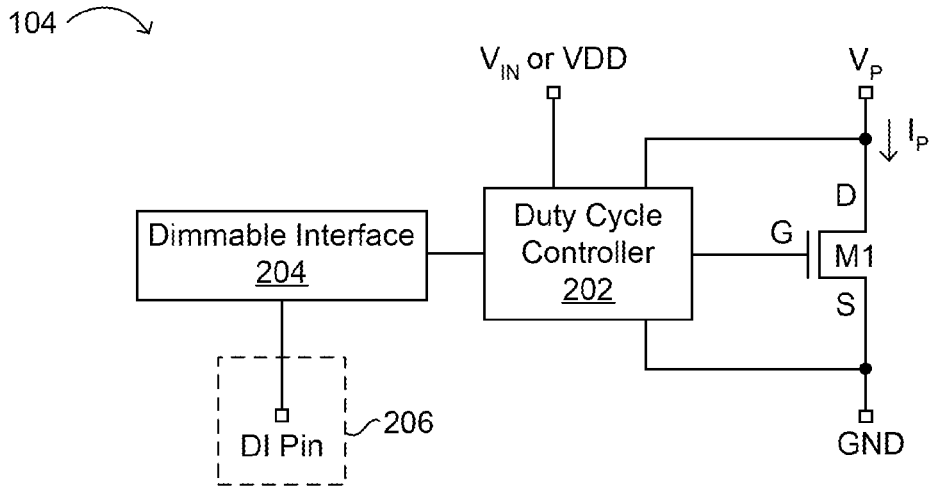
FIG. 2 is a block schematic diagram showing an exemplary LED controller circuit in accordance with embodiments of the present invention.

FIG. 2 shows a block schematic diagram 104 of an exemplary LED controller circuit in accordance with embodiments of the present invention. LED controller 104 can include duty cycle controller 202, configured to control transistor M1. For example, transistor M1 can be a MOS (e.g., NMOS) transistor with a source coupled to GND, a drain coupled to $V_P$, and a gate coupled to an output from duty cycle controller 202. In this fashion, duty cycle controller 202 can control a current $I_P$ through transistor M1, thereby controlling the release of stored energy from transformer T1 (see FIG. 1) and indirectly affecting the secondary current ($I_S$), the secondary voltage ($V_S$), the output current ($I_O$) and/or the output voltage ($V_O$).

While an NMOS transistor is shown in this particular example, any suitable type of transistor, switching, or current controlling device (e.g., bipolar junction transistor [BJT], potentiometer, etc.), can be used in particular embodiments. Also, while a 3-pin interface to LED controller 104 is shown in the particular examples of FIGS. 1A and 1B, other pins can also be included. For example, an extra pin (e.g., dimmable interface [DI] pin 206) may be included to support an LED dimming function. For example, such an extra dimming control pin can receive a user input (e.g., from a manual switch or knob, or from an analog or multi-bit digital electrical signal over a network) or other control signal, and provide the same to dimmable interface 204 for additional control of a resistance or other circuit parameter to support a dimming adjustment to secondary winding current $I_S$. As another example, communication through a conventional powerline network can be used for dimming control without an extra pin to LED controller 104.

Figure 3A:
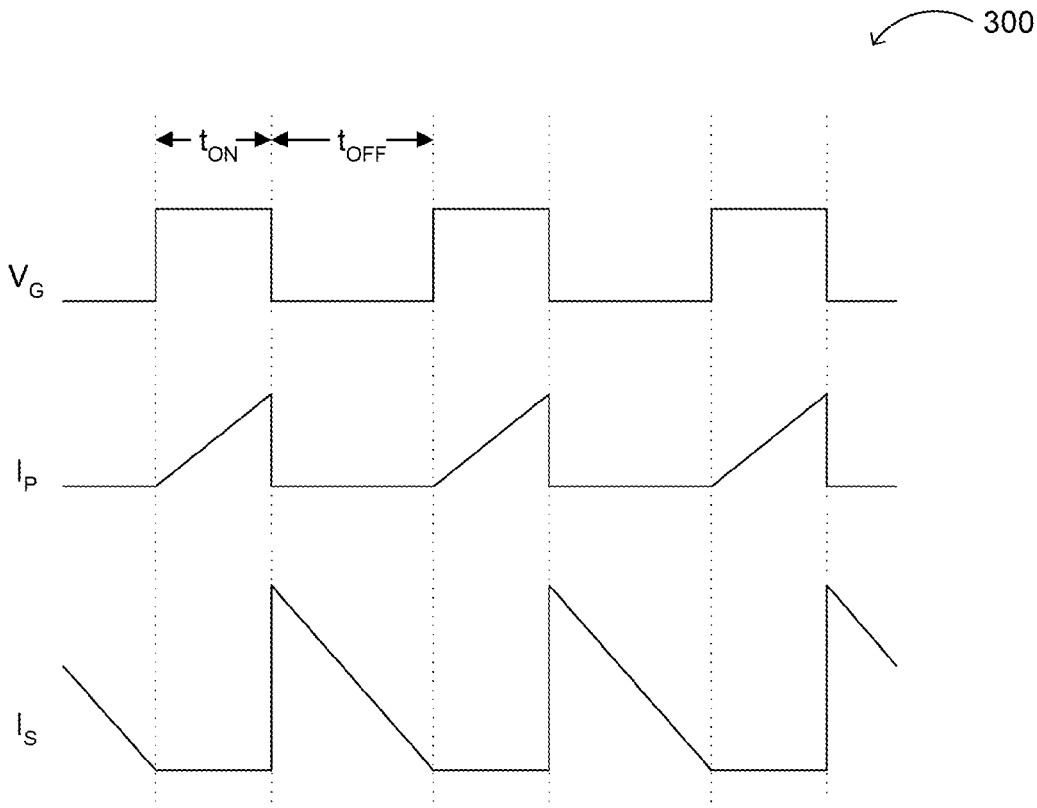
FIG. 3A is a waveform diagram showing an exemplary LED control operation for a critical transition mode in accordance with embodiments of the present invention.
Figure 3B:
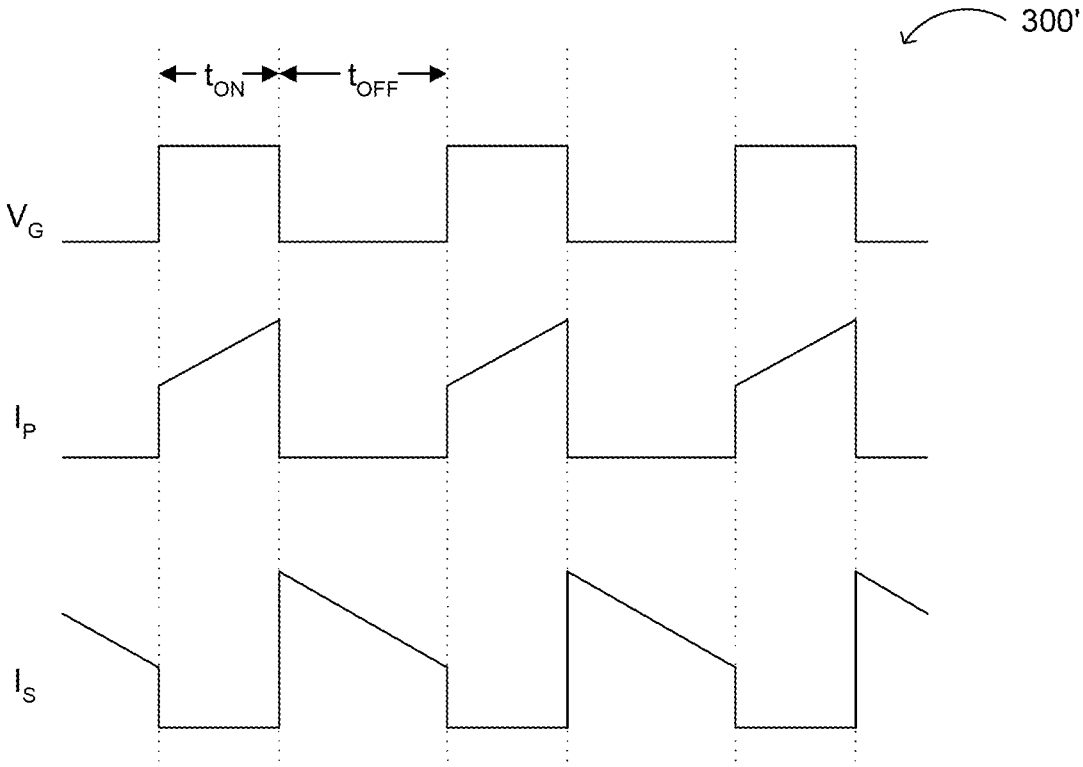
FIG. 3B is a waveform diagram showing an exemplary LED control operation for a continuous current mode in accordance with embodiments of the present invention.
Figure 3C:
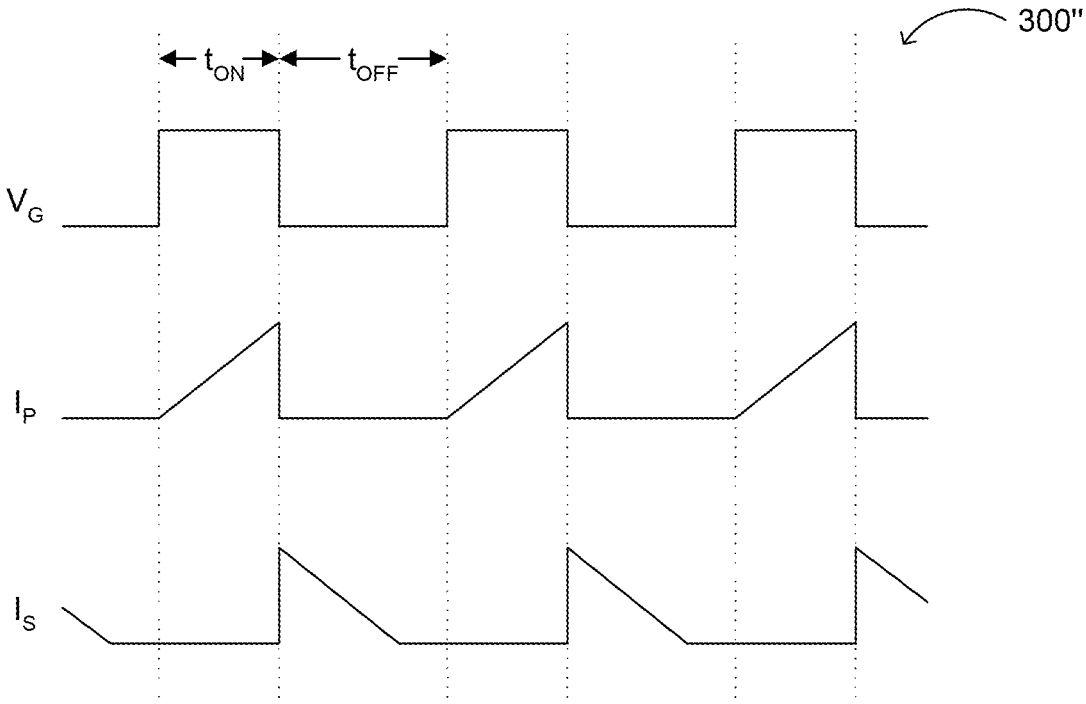
FIG. 3C is a waveform diagram showing an exemplary LED control operation for a discontinuous current mode in accordance with embodiments of the present invention.

FIGS. 3A-3C show waveform diagrams of exemplary LED control operations in accordance with embodiments of the present invention. A voltage ($V_G$) on or to the gate (G) of transistor M1 is shown with duty cycle $t_{ON}+t_{OFF}$ indicating control of the transistor M1. The length of time $t_{ON}$ corresponds to a pulse during which the transistor M1 is on, and the length of time $t_{OFF}$ corresponds to an inactive period between pulses during which the transistor M1 is off. The primary current $I_P$ is shown as generally ramping up during the pulse time $t_{ON}$ due to the transistor M1 sinking current from the primary winding or coil of transformer T1 to ground potential GND. The secondary current is shown as generally ramping down during the time period $t_{OFF}$ as transistor M1 prevents a discharge path (e.g., by forming a high impedance) from the second pin ($V_P$) to ground potential GND, thereby causing current not to pass through the primary winding of transformer T1 (FIGS. 1A-1B).

Referring to FIG. 2, in certain embodiments, the primary current $I_P$ can be sampled during pulse times $t_{ON}$ (when $I_S$ is substantially zero, or "off") by duty cycle controller 202, and the primary voltage $V_P$ can be sampled during the time periods $t_{OFF}$ between pulses (when $I_S$ is a non-zero value, or "on"). In addition, various modes of operation and/or waveform types for the primary and secondary currents $I_P$ and $I_S$ can be supported in particular embodiments. In FIG. 3A, a critical transition mode example 300 is shown, whereby a rising edge of $V_G$ corresponds to a critical transition of $I_S$ (from a positive value to zero) and $I_P$ (from zero to a positive value).

In FIG. 3B, a continuous current mode example 300' is shown, whereby the primary and secondary currents $I_P$ and $I_S$ vary in a predictable manner, but the primary and secondary currents $I_P$ and $I_S$ is never zero. In FIG. 3C, a discontinuous current mode example 300" is shown, whereby the primary and secondary currents $I_P$ and $I_S$ vary in a predictable manner during the duty cycle, but the secondary current $I_S$ reaches zero before the end of each cycle (e.g., $I_S$ equals zero during a terminal portion of $t_{OFF}$). The converter (e.g., controller 202 in FIG. 2) may be designed to operate in a continuous mode at relatively high power, and in a discontinuous mode at relatively low power.

An Exemplary Duty Cycle Controller for LED Control

Figure 4A:
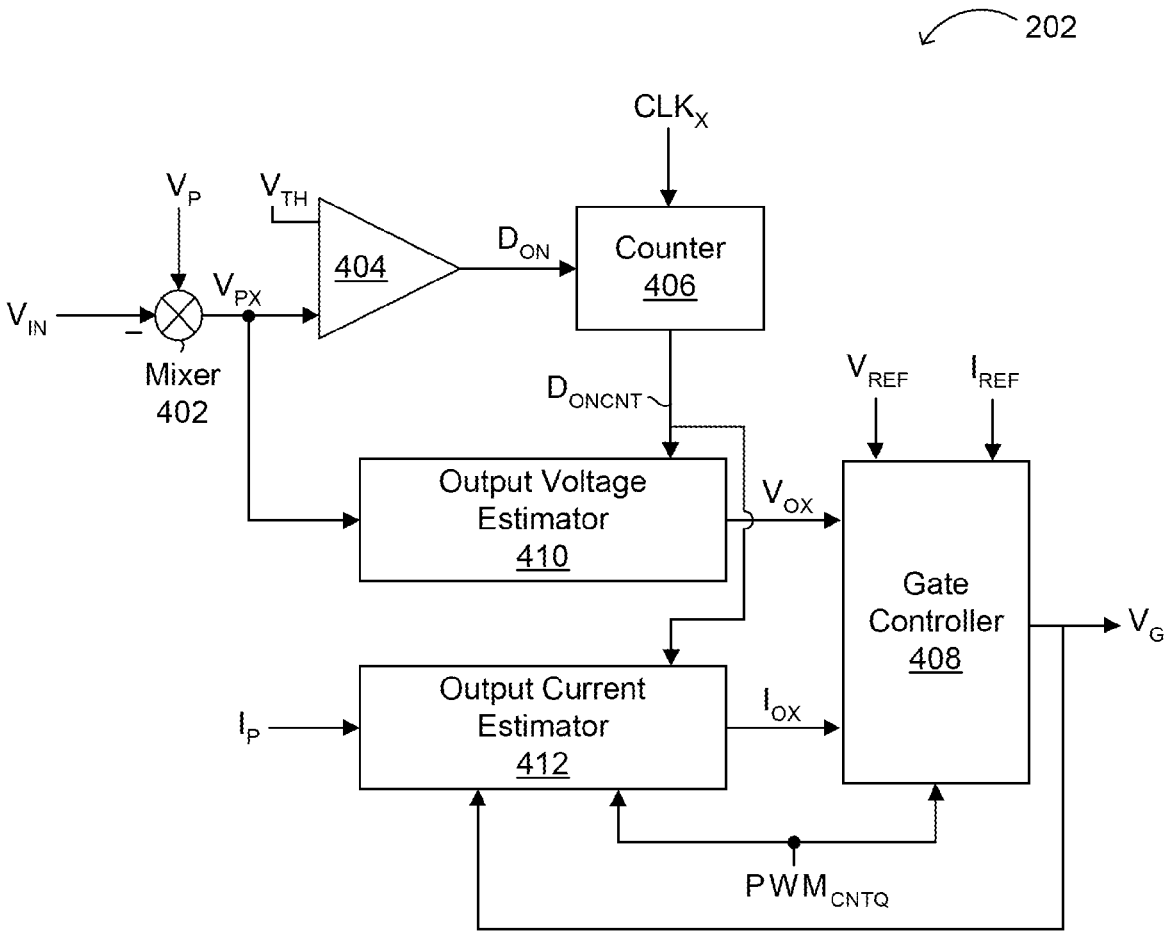
FIG. 4A is a block schematic diagram showing an exemplary duty cycle controller for LED control in accordance with embodiments of the present invention.

FIG. 4A shows a block diagram of an exemplary duty cycle controller 202 for LED control in accordance with embodiments of the present invention. Mixer 402 receives input supply $V_{IN}$ and primary winding voltage $V_P$, and provides a control signal $V_{PX}$ therefrom by subtracting $V_{IN}$ from $V_P$ (or vice versa). Comparator 404 compares the control signal $V_{PX}$ against a predefined threshold value $V_{TH}$. In some embodiments, $V_{TH}$ can be a relatively stable and/or fixed reference voltage, generated by a conventional voltage divider or voltage generator. If $V_{PX}>V_{TH}$, the output $D_{ON}$ of comparator 404 is active, indicating that the secondary side winding has a non-zero current. Otherwise, comparator output $D_{ON}$ is not active, indicating that the secondary side winding has no current. The comparator output signal $D_{ON}$, which may be digital in one embodiment, is provided to counter 406.

Counter 406 counts the number of periods of a clock signal ($CLK_X$) during which the output $D_{ON}$ of comparator 404 is active. The clock signal ($CLK_X$) comprises a conventional reference clock having a fixed frequency (e.g., between 1 and $10^{11}$ Hz) and, in one embodiment, a duty cycle of 50%. The clock signal ($CLK_X$) may be provided by an on-chip or off-chip frequency generator (an RC circuit, a phase-locked loop

[PLL] or delay-locked loop [DLL] which can include a voltage- or current-controlled oscillator, a crystal oscillator, etc.). Counter 406 can be implemented as any suitable type of counter (e.g., a digital counter using flip-flops, etc.). Counter 406 then provides a count signal $D_{ONCNT}$ to output voltage estimator 410, where $D_{ONCNT}$ indicates the number of $CLK_X$ cycles for which $D_{ON}$ is active. $D_{ONCNT}$ generally represents the time during which secondary diode D5 (see FIG. 1A and/or FIG. 1B) is conducting, or on. Thus, in one implementation, $D_{ON}$ can function as an enable signal for a counter receiving a periodic signal $CLK_X$.

Output voltage estimator 410 estimates the output voltage $V_O$ by sensing or sampling the primary voltage $V_P$ during the time when the secondary side winding current, $I_s$, is not zero and D5 (FIG. 1A and/or FIG. 1B) is conducting (e.g., while transistor M1 is off), averaging the sensed or sampled voltages, and converting the average value into an estimated output voltage $V_{OX}$ in the LED (e.g., at the secondary winding, after passing through a filter, or at an input to the LED).

As discussed above, $V_{IN}$ is subtracted from $V_P$ at mixer 402 to provide control signal $V_{PX}$. This control signal may be sampled once per cycle of clock signal $CLK_X$, averaged during the LED on time using $D_{ONCNT}$, and then divided by N, the primary to secondary winding ratio of transformer T1 (corresponding to the transformed voltage ratio across T1), to give an estimation of the transformer output voltage ($V_O$) to the LED as $V_{OX}$. For example, output voltage estimator 410 can use a formula as shown below in Equation 1:

$$V_{OX} = \sum_{D_{ON}} V_{PX} / (N * D_{ONCNT}) \quad (1)$$

Output current estimator 412 estimates the output current $I_O$ by sensing or detecting the primary current $I_P$ during the time when transistor M1 is on, averaging the sampled currents $I_P$ and converting that average value into output current estimation $I_{OX}$ (or into estimated secondary current $I_S$). For example, output current estimator 412 can use a formula as shown below in Equation 2:

$$I_{OX} = N * D_{ONCNT} * \sum_{T_{ON}} I_P / (T_{ONCNT} * PWM_{CNTQ}) \quad (2)$$

Figure 4B:
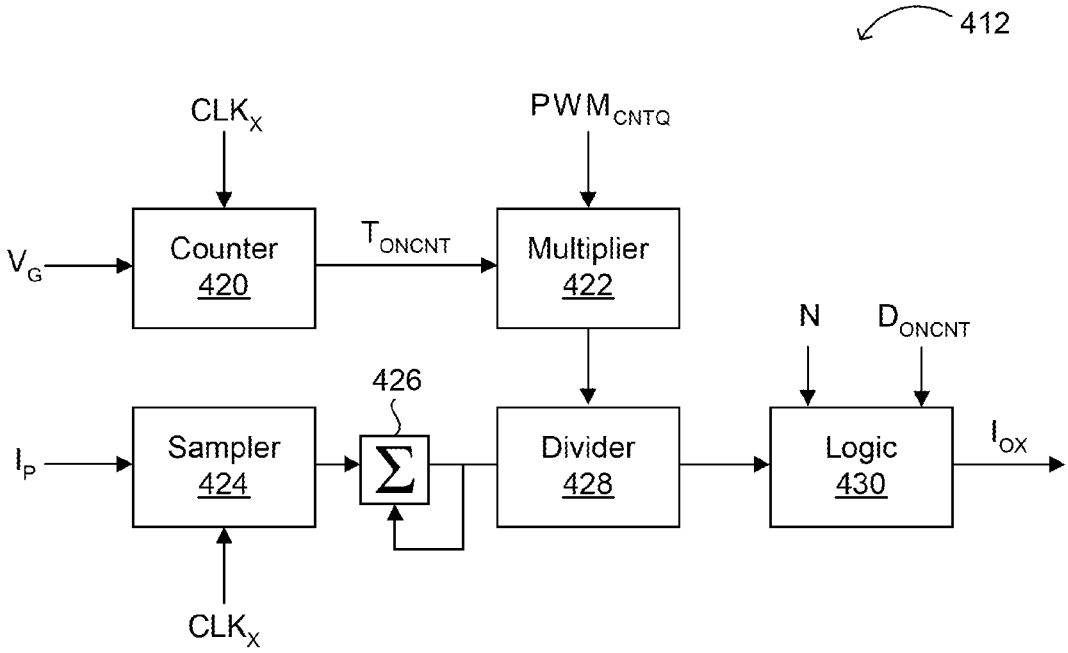
FIG. 4B is a block diagram showing an exemplary output current estimator in accordance with embodiments of the present invention.

Referring now to FIG. 4B, a counter 420 receiving the output $V_G$ of gate controller 408 (FIG. 4A) and a clock signal such as, e.g., $CLK_x$ (or another suitable counter) can determine $T_{ONCNT}$ in a manner similar to the determination of signal $D_{ONCNT}$ by counter 406 in FIG. 4A. Also, a pulse width modulation (PWM) control signal (e.g., $PWM_{CNTQ}$), which can be a binary or multi-bit digital signal and which can assist in controlling the shape and/or width of the pulse $V_G$ output to the gate G of transistor M1 (see FIGS. 2 and 4C), can be received along with $T_{ONCNT}$ at multiplier 422 (FIG. 4B) to be combined (e.g., multiplied) as described in formula (2) above.

Primary current $I_P$ is sampled at sampler 424 (e.g., at the frequency of the clock signal $CLK_X$ or a frequency defined by the clock signal $CLK_X$, such as an integer multiple and/or divisor of such frequency), and the samples are summed at summer 426. Divider 428 divides the summed primary current samples by the output of logic gate 422 (e.g., $T_{ONCNT}$*$PWM_{CNTQ}$) to generate the third multiplied term of formula (2) above. Logic 430 receives and performs one or more mathematical operations on (e.g., multiplies) the terms N and $D_{ONCNT}$ and the output of divider 428 to generate the estimated output current $I_{OX}$. In various embodiments, logic 430 may comprise one or more multipliers (which can be in series if logic 430 comprises a plurality of multipliers). However, the actual design and/or implementation of logic 430 is known to and/or within the level of skill of those skilled in the art.

Figure 4C:
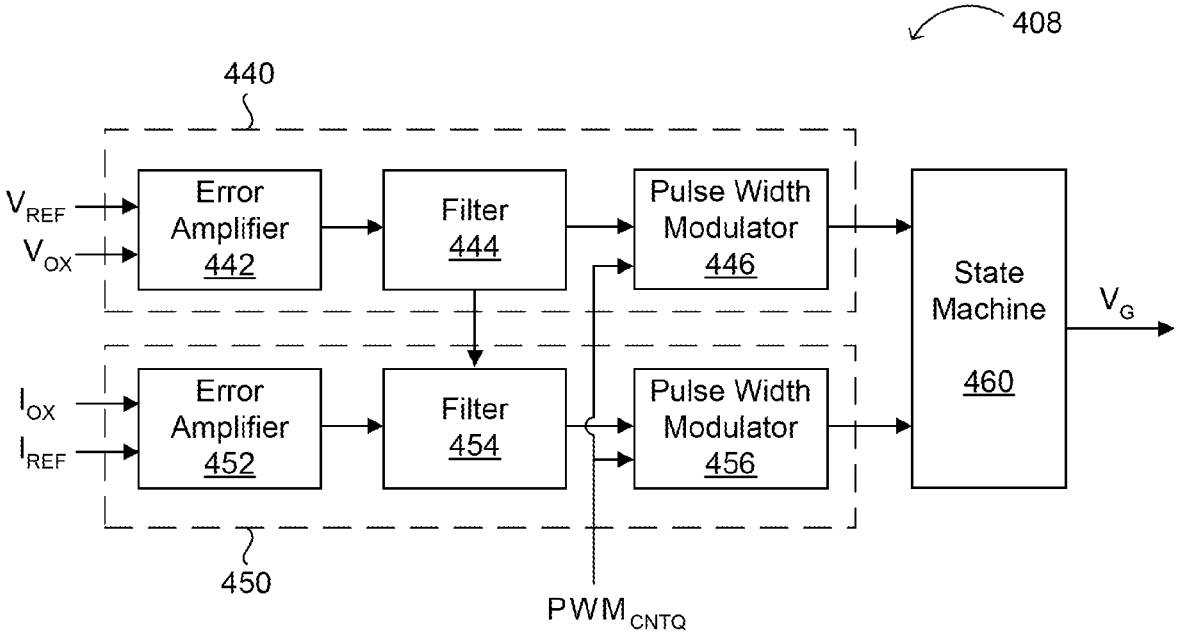
FIG. 4C is a block diagram showing an exemplary gate controller in accordance with embodiments of the present invention.

Referring back to FIG. 4A, gate controller 408 receives $V_{OX}$ and $I_{OX}$, as well as references $V_{REF}$ and $I_{REF}$, and can provide gate control signal $V_G$ therefrom. Referring now to FIG. 4C, for example, controller 408 can include parallel paths 440 and 450 for $V_{OX}$ and $I_{OX}$, respectively, each comprising an error amplifier (e.g., 442, 452), a loop filter (e.g., 444, 454), and a pulse width modulator (e.g., 446, 456). Controller 408 further comprises a state machine 460 receiving outputs from the parallel paths 440 and 450. The $V_{OX}$ path 440 can include a $V_{OX}$ error amplifier 442 receiving $V_{REF}$ and $V_{OX}$, and provide an output to a $V_{OX}$ loop filter 444. The $I_{OX}$ path 450 can include an $I_{OX}$ error amplifier 452 receiving $I_{REF}$ and $I_{OX}$, and provide an output to an $I_{OX}$ loop filter 454. Error amplifier 442 can comprise a conventional amplifier configured to amplify a difference in voltage between $V_{REF}$ and $V_{OX}$, and current error amplifier 452 can comprise a conventional amplifier configured to amplify a difference in current between $I_{REF}$ and $I_{OX}$.

Also, the $V_{OX}$ path 440 can comprise a $V_{OX}$ pulse width modulator (PWM) 446 receiving the filtered $V_{OX}$ error amplifier output and a PWM control signal $PWM_{CNTQ}$ and provide a filtered, modulated $V_{OX}$ error (or difference) pulse to the state machine 460. Likewise, the $I_{OX}$ path 450 can comprise an $I_{OX}$ pulse width modulator (PWM) 456 receiving the filtered $V_{OX}$ error amplifier output and the PWM control signal $PWM_{CNTQ}$ and provide a filtered, modulated $I_{OX}$ error (or difference) pulse to the state machine 460. It is within the ability of one skilled in the art to implement the state machine to create $V_G$ pulses (e.g., as shown in FIGS. 3A-3C) from $V_{OX}$ and $I_{OX}$ paths 440 and 450, as shown in FIG. 4C. Other arrangements for controller 408, including one of the pulse width modulators 446 or 456 receiving a different or complementary PWM control signal, sharing of components between the $I_{OX}$ and $V_{OX}$ error amplifiers 442 and 452 and/or loop filters 444 and 454, etc., can also be accommodated in particular embodiments.

An Exemplary Method of Controlling an LED

Figure 5:
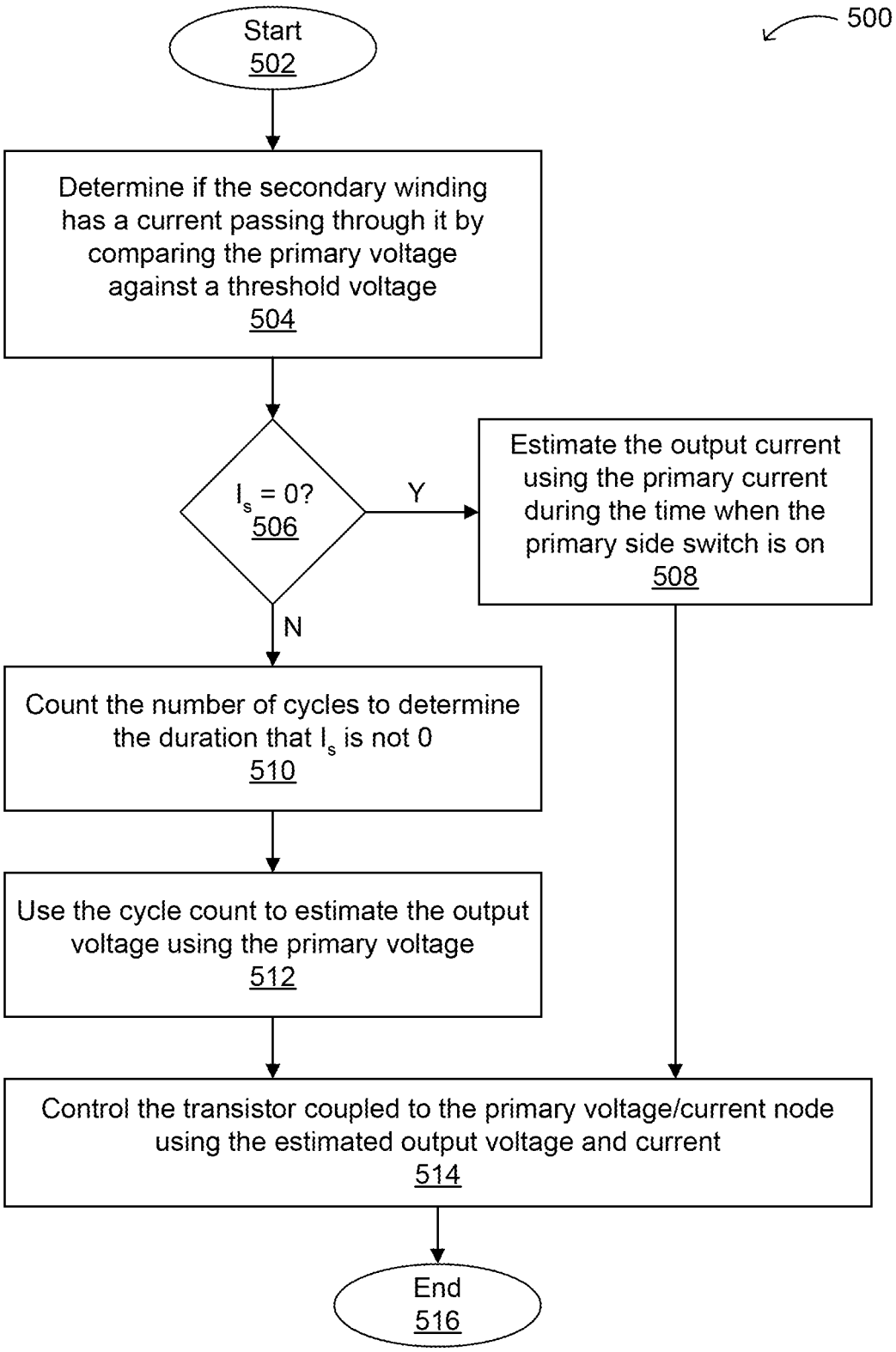
FIG. 5 is a flow diagram showing an exemplary method of controlling an LED in accordance with embodiments of the present invention.

Referring now to FIG. 5, shown is a flow diagram 500 of an exemplary method of controlling an LED in accordance with embodiments of the present invention. The flow begins (502), and a determination can be made as to whether the secondary side winding has a current passing through it by comparing (e.g., via mixer 402 and comparator 404; see FIG. 4A) the primary voltage at a primary winding of a transformer against a threshold voltage (see block 504 in FIG. 5). This comparison indicates whether a corresponding secondary winding of the transformer, which is coupled via an output path to the LED, has a current passing through it (e.g., $D_{ON}$ is activated or not).

If the secondary side winding current is zero (506), a current through an output path on a secondary winding side of the transformer can be estimated by using the current $I_P$ through the primary winding (508) when the primary side switch is on. For example, the current estimation can be performed using output current estimator 412 in FIG. 4A (e.g., as in Equation (2) above). Referring back to FIG. 5, if the secondary side winding current is not zero (506), a number of clock cycles that the LED is on can be counted (510), such as by using counter 406. This number of clock cycles (e.g., $D_{ONCNT}$) can be used for estimating a voltage at an LED coupled to the secondary winding of the transformer (512). For example, the voltage estimation can be performed using output voltage estimator 410 in FIG. 4A (e.g., as in Equation (1) above). A transistor (e.g., NMOS transistor M1 in FIG. 2) coupled to the primary winding of the transformer can then be controlled using the estimated current and voltage (see block 514 in FIG. 5), completing the flow (516; FIG. 5).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A light-emitting diode (LED) control circuit, the LED control circuit comprising:

a first input configured to receive an input voltage supply;

a second input configured to receive a primary signal from a primary winding of a transformer coupled to said LED; and logic configured to estimate an output current and/or voltage at said LED coupled to a secondary winding of said transformer from said input voltage supply and said primary signal, wherein said primary signal includes a primary voltage and a primary current of said transformer, wherein said logic comprises an output voltage estimator configured to estimate said output voltage from said input voltage supply and said primary voltage; and an output current estimator configured to receive said primary current and to estimate said output current from said primary current when a switch coupled to said second input is on.

2. The circuit of claim 1, wherein said logic further comprises a mixer configured to receive said input voltage supply and said primary voltage, said mixer providing a control voltage therefrom.

3. The circuit of claim 2, wherein said logic further comprises a voltage control circuit configured to receive said control voltage, a threshold voltage and a clock signal, said voltage control circuit generating a voltage control indicator therefrom.

4. The circuit of claim 3, wherein said voltage control circuit comprises:

a comparer configured to compare said control voltage and said threshold voltage; and a counter configured to receive said clock signal and an output from said comparator, said counter providing said voltage control indicator.

5. The circuit of claim 4, wherein said voltage control indicator has a value corresponding to a length of time that said control voltage exceeds said threshold voltage.

6. A method of controlling a light-emitting diode (LED), the method comprising:

determining if a current is passing through a secondary winding of a transformer by comparing a threshold voltage and a primary voltage at a primary winding of the transformer;

estimating an output current through said LED from a current through said primary winding when a switch coupled to said secondary winding is on; and counting a number of clock cycles that said secondary side winding has a non-zero current, and estimating an output voltage at said LED or at a secondary winding of said transformer using said primary voltage when said switch is off.

7. The method of claim 6, further comprising generating a pulse from said estimated output current and said estimated output voltage.

8. The method of claim 7, further comprising producing a current at a terminal of said primary winding by applying said pulse to a gate of a transistor coupled to said primary winding.

9. The method of claim 7, wherein estimating the output current further comprises:

sampling said current at a terminal of said primary winding;

counting a number of cycles of said clock signal while said pulse is active; and averaging said sampled current during said number of cycles while said pulse is active.

10. The method of claim 9, wherein said output current is estimated according to $$I_{OX} = N * D_{ONCNT} * \sum_{T_{ON}} I_P / (T_{ONCNT} * PWM_{CNTQ}),$$

wherein $D_{ONCNT}$ indicates a number of clock cycles for which a diode coupled to said secondary winding is on, N indicates a transformer winding ratio, $I_P$ indicates said current at said terminal of said primary winding, $T_{ONCNT}$ indicates said number of cycles while said pulse is active, and $PWM_{CNTQ}$ indicates a value of a pulse width modulation (PWM) control signal or a switching period.

11. The method of claim 6, wherein estimating the output voltage further comprises:

mixing said input voltage supply and a voltage at a terminal of said primary winding, and providing a control voltage therefrom;

comparing said control voltage against a threshold voltage, and generating a diode on indicator therefrom;

counting a number of cycles of said clock signal while said diode on indicator is active; and estimating said output voltage using said number of cycles and said control voltage.

12. The method of claim 11, wherein said output voltage is estimated according to $$V_{OX} = \sum_{D_{ON}} V_{PX} / (N * D_{ONCNT}),$$

wherein $D_{ONCNT}$ indicates the number of clock cycles for which said diode on indicator is active, N indicates a transformer winding ratio, and $V_{PX}$ indicates said control voltage.

13. An apparatus for controlling a light-emitting diode (LED), the apparatus comprising:

a transformer having a primary winding and a secondary winding, wherein said secondary winding is coupled to said LED; and a controller having a first input coupled to an input voltage supply and a first terminal of said primary winding, and a second input coupled to a second terminal of said primary winding, wherein said controller is configured to estimate an output voltage and an output current provided from said secondary winding to said LED from said input voltage supply, a primary voltage at a terminal of said primary winding, and a primary current at said second input, and provide an LED control signal from said estimated output voltage and said estimated output current.

14. The apparatus of claim 13, further comprising an NMOS transistor having a source coupled to said ground supply, a drain coupled to said terminal of said primary winding, and a gate receiving said LED control signal.

15. The apparatus of claim 13, wherein said controller comprises:

an output voltage estimator configured to estimate the output voltage from the input voltage supply and the primary voltage; and an output current estimator configured to estimate the output current from said primary current when a switch receiving said LED control signal and coupled to said terminal said primary winding is on.

16. The apparatus of claim 15, wherein said controller further comprises:

a mixer configured to receive said input voltage supply and said primary voltage, and to provide a control voltage therefrom;

a comparator configured to compare said control voltage against a threshold voltage, and to generate a diode on indicator therefrom; and a counter configured to receive said diode on indicator and a clock signal, and to count a number of cycles of said clock signal when said diode on indicator is active.

17. The apparatus of claim 16, wherein said output voltage estimator estimates said output voltage according to $$V_{OX} = \sum_{D_{ON}} V_{PX} / (N * D_{ONCNT}),$$

wherein $D_{ONCNT}$ indicates the number of clock cycles for which said diode on indicator is active, N indicates a transformer winding ratio, and $V_{PX}$ indicates said control voltage.

18. The apparatus of claim 16, wherein said output current estimator estimates said output current according to $$I_{OX} = N * D_{ONCNT} * \sum_{T_{ON}} I_P / (T_{ONCNT} * PWM_{CNTQ}),$$

wherein $D_{ONCNT}$ indicates a number of clock cycles for which said diode on indicator is active, N indicates a transformer winding ratio, $I_P$ indicates said primary current, $T_{ONCNT}$ indicates said number of cycles while said pulse is active, and $PWM_{CNTQ}$ indicates a value of a pulse width modulation (PWM) control signal.

* * * * *